US011029075B2

(12) United States Patent
Yi et al.

(10) Patent No.: US 11,029,075 B2
(45) Date of Patent: Jun. 8, 2021

(54) DOOR FOR HOME APPLIANCE AND HOME APPLIANCE HAVING THE SAME

(71) Applicant: LG ELECTRONICS INC., Seoul (KR)

(72) Inventors: Myeongha Yi, Seoul (KR); Nami Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/500,936

(22) PCT Filed: Jul. 14, 2016

(86) PCT No.: PCT/KR2016/007682

§ 371 (c)(1),
(2) Date: Feb. 1, 2017

(87) PCT Pub. No.: WO2017/010828

PCT Pub. Date: Jan. 19, 2017

(65) Prior Publication Data

US 2018/0112906 A1 Apr. 26, 2018

(30) Foreign Application Priority Data

Jul. 14, 2015 (KR) ..... 10-2015-0099662
Jan. 5, 2016 (KR) ..... 10-2016-0001137

(51) Int. Cl.
*F25D 21/04* (2006.01)
*F25D 23/02* (2006.01)
*A47F 3/04* (2006.01)

(52) U.S. Cl.
CPC ..... *F25D 21/04* (2013.01); *F25D 23/02* (2013.01); *A47F 3/043* (2013.01); *A47F 3/0434* (2013.01);
(Continued)

(58) Field of Classification Search
CPC ..... F25D 21/04; F25D 23/02; F25D 23/028; F25D 2323/023; F25D 2400/02; F25D 2400/18; A47F 3/043; A47F 3/0434
See application file for complete search history.

(56) References Cited

U.S. PATENT DOCUMENTS 4,496,201 A * 1/1985 Allgeyer ..... A47F 3/043 312/296
5,048,233 A * 9/1991 Gidseg ..... E06B 3/78 126/198
(Continued)

FOREIGN PATENT DOCUMENTS

CN 201865518 6/2011
CN 203629192 6/2014
(Continued)

OTHER PUBLICATIONS

JPH0452487 Translated Description, 3 pages (Year: 1992).*
(Continued)

*Primary Examiner* — Andrew M Roersma
(74) *Attorney, Agent, or Firm* — Fish & Richardson P.C.

(57) ABSTRACT

The present invention provides a door for a home appliance including a panel assembly including a front panel defining at least a portion of a front appearance of the door, a rear panel disposed behind the front panel, and a spacer disposed between a peripheral portion of the front panel and a peripheral portion of the rear panel so as to maintain a spacing between the front panel and the rear panel, a frame assembly for supporting the panel assembly, the frame assembly including a side frame disposed along a side surface of the door, the side frame contacting outside air, and a heat transfer structure for transferring heat of outside air from the side frame to an interior region defined between the front panel and the rear panel and between the spacer and a
(Continued)

side end of the door, and a home appliance including the same.

15 Claims, 7 Drawing Sheets

(52) U.S. Cl.
CPC .. *F25D 2323/021* (2013.01); *F25D 2323/023* (2013.01); *F25D 2400/02* (2013.01); *F25D 2400/18* (2013.01)

(56) References Cited

U.S. PATENT DOCUMENTS 5,111,618 A 5/1992 Kaspar
5,255,473 A 10/1993 Kaspar
RE35,149 E * 1/1996 Richardson ..... A47F 3/043 49/501
5,910,083 A * 6/1999 Richardson ..... E06B 3/66366 312/116
8,142,038 B2 * 3/2012 Li ..... F21V 33/0044 362/125
8,312,694 B2 * 11/2012 Hecht ..... F25D 23/02 312/116
8,776,443 B2 * 7/2014 Bienick ..... E05D 7/1011 49/501
8,869,493 B2 * 10/2014 Chubb ..... E06B 7/16 312/138.1
9,016,031 B2 * 4/2015 Chubb ..... A47F 3/043 52/786.1
10,228,182 B2 * 3/2019 Choi ..... F25D 23/02
2007/0062226 A1 * 3/2007 Gomoll ..... A47F 3/0434 68/34
2012/0104909 A1 * 5/2012 Kaplan ..... F25D 23/02 312/204
2012/0286638 A1 * 11/2012 Lee ..... F25D 27/00 312/405
2013/0239484 A1 9/2013 Chubb
2014/0375200 A1 12/2014 Kim
2015/0020451 A1 1/2015 Chubb et al.
2016/0045038 A1 * 2/2016 Chubb ..... A47F 3/0434 312/116

FOREIGN PATENT DOCUMENTS

EP 381646 A1 8/1990
JP H0452487 2/1992
JP H07035467 2/1995
JP H0791815 4/1995
JP 02892781 A1 5/1999
JP 20070130193 5/2007
KR 10-2014-0128098 11/2014
TW 201352052 12/2013
TW 201512619 4/2015
WO WO-2009024498 A1 * 2/2009 ..... A47F 3/0434

OTHER PUBLICATIONS

Translation JPH0452487U, 3 pages (Year: 1992).*
Translation CN203629192U, 5 pages (Year: 2014).*
Translation CN201865518U, 3 pages (Year: 2011).*
Extended European Search Report in European Application No. 16805957.4, dated Jan. 25, 2018, 8 pages.
Chinese Office Action in Chinese Appln. No. 201680001974.9, dated Jan. 21, 2019, 17 pages (with English translation).
AU Office Action in Australian Appln. No. 2020200727, dated Feb. 18, 2021, 7 pages.

* cited by examiner

DOOR FOR HOME APPLIANCE AND HOME APPLIANCE HAVING THE SAME

CROSS REFERENCE TO RELATED APPLICATIONS

This application is a U.S. National Phase Application under 35 U.S.C. § 371 of International Application PCT/KR2016/007682 filed on Jul. 14, 2016, which claims the benefit of Korean Application No. 10-2015-0099662, filed on Jul. 14, 2015, and Korean Application No. 10-2016-0001137, filed on Jan. 5, 2016, the entire contents of which are hereby incorporated by reference in their entireties.

TECHNICAL FIELD

The present disclosure relates to a door for home appliance and home appliance having the same. Particularly, the present disclosure relates to a refrigerator door and a refrigerator.

BACKGROUND ART

In general, refrigerators are apparatuses for keeping stored objects in a frozen or refrigerated state by maintaining a storage region defined therein at a predetermined temperature by means of a refrigeration cycle realized via a compressor, a condenser, an expansion valve, and an evaporator. Accordingly, a refrigerator includes storage regions, for example, a freezing compartment and a refrigerating compartment. Refrigerators may be classified into various kinds of refrigerators depending on the positions of a freezing compartment and a refrigerating compartment. For example, refrigerators may be classified into several kinds of refrigerators, including a top-mounting type refrigerator, in which a freezing compartment is located above a refrigerating compartment, a bottom-freezer type refrigerator, in which a freezing compartment is located below a refrigerating compartment, a side-by-side type refrigerator, in which a freezing compartment and a refrigerating compartment are isolated from each other by means of a partition so as to be located on left and right sides, and the like. Furthermore, refrigerators may be classified into a household refrigerator, which is used in the home, and a commercial refrigerator, which is used in eating places, convenience stores or the like.

A freezing compartment and a refrigerating compartment are defined in a cabinet forming the appearance of the refrigerator, and are selectively opened or closed by a freezing compartment door and a refrigerating compartment door, respectively. Some refrigerators also include an interactive touch-input panel provided on a front surface of a door of the refrigerator. Such touch-input panels allow a user to control various functions of the refrigerator by applying a touch-input to the front surface of the refrigerator door. Some refrigerators are provided with a door made of glass so as to enable the inside of the refrigerator to be visible from the outside without opening the door. However, since a household refrigerator is provided with a freezing compartment door and a refrigerating compartment door that are opaque, the inside of the freezing compartment or the refrigerating compartment is typically made visible only by opening the freezing compartment door or the refrigerating compartment door.

Some household refrigerators enable the inside thereof to be visible without opening the refrigerator door, thus reducing the loss of cold air caused by frequent opening and closing of the door. In this type of refrigerator, the door is commonly constructed so as to include a transparent window enabling the inside of the refrigerator to be visible from the outside, and a transparent window support part for supporting the transparent window. However, since the transparent window of the door is generally made of glass, there is a disadvantage in that condensation forms on the glass due to the limited thermal insulation capacity of the glass.

Some refrigerators have been designed to overcome this disadvantage. Examples of such refrigerators are described in Korean Unexamined Patent Publication No. 10-2013-0113273 and Chinese Unexamined Patent Publication No. 104061740A. Korean Unexamined Patent Publication No. 10-2013-0113273 is directed to a commercial showcase refrigerator, in which a frame having no thermal insulation value supports a glass window. According to this patent, a heating wire is utilized to heat the glass window to prevent condensation on the glass window, but the heating wire is designed to heat the entire glass window, resulting in a disadvantage of excessive power consumption.

Furthermore, Chinese Unexamined Patent Publication No. 104061740A is directed to a refrigerator in which a door includes three glass sheets and a frame support part for supporting the three glass sheets. The middle glass sheet of the triple glass sheet is provided on the entire area thereof with an electric heating film, such as an indium-tin oxide conductive film, which serves to heat the entire area of the middle glass sheet to prevent condensation. However, since the heating film also heats the entire area of the middle glass sheet, there is also a disadvantage of excessive electric energy being consumed and the structure being complicated.

As described above, the related arts are commonly configured to heat the entire panel using a heating wire or heating film to compensate for the limited thermal insulation capacity of the panel or glass window itself. Since these related arts heat the entire glass window, excessive electric energy is consumed, and the structure is complicated.

DISCLOSURE

Technical Problem

The present disclosure solves the above problems by providing a refrigerator door and a refrigerator that reduce power consumption and more efficiently prevents condensation on a panel using a simplified structure.

Technical Solution

In accordance with an aspect of the present invention, there are provided a door for a home appliance including a panel assembly including a front panel defining at least a portion of a front appearance of the door, a rear panel disposed behind the front panel, and a spacer disposed between a peripheral portion of the front panel and a peripheral portion of the rear panel so as to maintain a spacing between the front panel and the rear panel, a frame assembly for supporting the panel assembly, the frame assembly including a side frame disposed along a side surface of the door, the side frame contacting outside air, and a heat transfer structure for transferring heat of outside air from the side frame to an interior region defined between the front panel and the rear panel and between the spacer and a side end of the door, and a home appliance including the same. The home appliance may be a refrigerator.

The panel assembly may include a rear frame connected to the rear panel, and the side frame may include a rear frame connector connected to the rear frame and a panel connector connected to the front panel.

The rear frame may include a first end connected to the rear panel and a second end connected to the side panel, the second end being connected to the rear frame inside the rear frame connector.

The rear frame and the side frame may be made of different materials, and the side frame may have a higher coefficient of heat transfer than the rear frame.

Specifically, the rear frame may be made of resin material, and the side frame may be made of metal. The resin material may be ABS material having a high thermal insulation value, and the metal may be aluminum having a high heat transfer property.

The heat transfer structure may include a heat transfer portion, the heat transfer portion being connected at one end thereof to the side frame and extending toward a side surface of the interior region. The heat of the side frame may be efficiently transferred to the interior region via the heat transfer portion. Specifically, heat may be transferred to a side surface of the interior region.

The remaining end of the heat transfer portion may be connected to the side surface of the interior region and may extend along the side surface of the interior region.

Cold air behind the panel assembly may be transferred to an area in front of the panel assembly through a peripheral portion of the panel assembly. Specifically, cold air may be transferred through the spacer. Accordingly, the interior region of the panel assembly outside the spacer may be supplied with heat rather than cold air.

To this end, outside heat may be supplied from the side frame via the heat transfer structure.

The side frame and the heat transfer structure may be integrally formed. As a result, more efficient heat transfer may be implemented.

The front panel may include a peripheral front panel portion having a larger width than the rear panel, and the interior region may include a rear surface of the peripheral front panel portion.

The heat transfer structure may be disposed at the peripheral front panel portion.

The door for a home appliance may further include a heating element disposed at the interior region of the panel assembly. The heating element may supply heat to the interior region, either in conjunction with or independently of the heat transfer structure.

The heating element may be disposed at the portion at which the front panel is coupled to the frame assembly.

The heating element may be constituted by a heating wire, and may be attached to the rear surface of the front panel using metal tape.

A thermal insulating space may be defined between the rear frame, the side frame and the interior region of the panel assembly, and may be provided therein with a thermal insulator.

The rear frame may be connected to the rear panel so as to cover the spacer, and a thermal insulator may be provided behind the spacer. As a result, it may be possible to primarily reduce transfer of cold air via the spacer by virtue of the rear frame and the thermal insulator.

The heat transfer structure may include a heat transfer portion, which penetrates the thermal insulating space so as to transfer heat from the side frame to the interior region of the panel assembly. In this case, the thermal insulator envelops a conduit for heat transfer formed by the heat transfer structure. As a result, it may be possible to achieve efficient heat transfer via the heat transfer structure.

The side frame may include an indented portion that is indented toward the inside of the door, the indented portion defining a handle of the door.

In accordance with an aspect of the present invention, there are provided a refrigerator door including a panel assembly including a front panel defining at least a portion of a front appearance of the door, a rear panel disposed behind the front panel, and a spacer disposed between a peripheral portion of the front panel and a peripheral portion of the rear panel so as to maintain a spacing between the front panel and the rear panel, a frame assembly for supporting the panel assembly, the frame assembly including a side frame disposed along a side surface of the door, the side frame contacting outside air, a heat transfer structure or a heat bridge for transferring heat of outside air from the side frame to an interior region defined between the front panel and the rear panel and between the spacer and a side end of the door, and a heating element disposed at the interior region of the panel assembly so as to provide heat to the interior region, and a refrigerator including the same. Obviously, the door may be applied not only to a refrigerator but also to a home appliance having a storage compartment.

The panel assembly may be a transparent panel, and the panel assembly may include a see-through region defined by a region inside the spacer and a non-see-through region outside the spacer.

The heat transfer structure and the heating element may be disposed at the non-see-through region. As a result, it may be possible to provide the refrigerator door including the see-through region with an improved aesthetic appearance by virtue of the heat transfer structure and the heating element.

In accordance with an aspect of the present invention, there is provided a door for a home appliance including a panel assembly including a front panel defining at least a portion of a front appearance of the door, a frame assembly for supporting the panel assembly, the frame assembly including a side frame disposed along a side surface of the door, and a heat transfer structure disposed behind the front panel so as to transfer heat to a region between the side frame and the front panel.

The front panel may include a peripheral front panel portion, to which the side frame is connected, and the heat transfer structure may be provided at the peripheral front panel portion.

The panel assembly may include a rear panel disposed behind the door, the panel assembly may include a rear frame connected to the rear panel, and the side frame may include a rear frame connector connected to the rear frame and a panel connector connected to the front panel.

The panel assembly may include an interior region defined between the front panel and the rear panel, the front panel may have a larger width than the interior region of the panel assembly, and the portion of the front panel that extends outward beyond the width of the interior region of the panel assembly may include the peripheral front panel portion.

The panel assembly may include one or more thermal insulation panels provided at the interior region of the panel assembly, the front panel may have a larger width than the maximum width of the one or more thermal insulation panels, and the portion of the front panel that extends beyond the maximum width of the one or more thermal insulation panels may include the peripheral front panel portion.

The side frame may be provided at the peripheral front panel portion.

The panel assembly may include an inner side surface defining a side surface of the interior region of the panel assembly, and the heat transfer structure may include a heat transfer portion, which is connected at one end thereof to the side frame of the panel assembly and extends toward the inner side surface.

The other end of the heat transfer portion may be connected to the inner side surface and may extend along the inner side surface.

The other end of the heat transfer portion may be connected to the peripheral front panel portion of the front panel and may extend along the peripheral front panel portion.

The front panel, the side frame and the inner side surface defining the side surface of the interior region of the panel assembly may define a thermal insulation region therebetween, and the heat transfer portion may extend from the side frame into the thermal insulation region.

The heat transfer structure may include a heating element for generating heat. Specifically, the heat transfer structure may perform transfer and generation of heat.

The heat transfer structure may be connected to the heating element.

The side frame may be connected to the peripheral front panel portion, and may extend along at least a portion of the length of the peripheral front panel portion.

The heating element may be provided at a predetermined position on the inner side surface of the panel assembly.

The heating element may be provided at the front panel of the panel assembly.

The heating element may be provided at a portion where the front panel is connected to the frame assembly.

The side frame and the heat transfer structure may be integrally formed.

The side frame may include an indented portion, and the indented portion may be indented toward the inside of the door.

The rear frame may be made of thermoplastic resin having a high heat transfer property, preferably ABS. The side frame and the heat transfer structure may be made of metal, preferably aluminum.

The front panel may have the same size as the door.

The front panel may be a touch-input panel.

The front panel may be a transparent glass panel.

The home appliance may be a refrigerator, the door may be a sub-door of a refrigerator, the refrigerator may include a cabinet and a main door for opening and closing the cabinet, and the sub-door may be a door of a home appliance, which is hingedly coupled to the main door.

In accordance with an aspect of the present invention, there is provided a refrigerator door including a panel assembly including a plurality of panels of thermally insulated glass and spacers disposed between the glass panels, a front glass panel of the plurality of glass panels having a peripheral portion larger than other glass panels; a side frame disposed behind the peripheral portion of the front glass panel, the side frame being connected at one end thereof to the peripheral portion of the front glass panel and at the other end thereof extending rearward from the peripheral portion of the front glass panel; a rear frame being connected at one end thereof to the side frame and at the other end thereof to the rear glass panel of the panel assembly; a thermal insulator disposed in the space defined between the rear frame, the side frame and the peripheral portion of the front glass panel; and a heat transfer structure (heat transfer frame) being connected at one end thereof to the side frame and at the other end thereof extending toward the edge of the panel assembly. The side frame and the heat transfer structure may be made of metal.

The heat transfer structure may be in close contact with the inner surface of the peripheral portion of the front glass panel.

In accordance with another aspect of the present invention, the present invention may further include another heat transfer structure, which is connected at one end thereof to the side frame and at the other end thereof extends toward the edge of the panel assembly through the thermal insulator. The other end of the heat transfer structure may extend along the edge of the panel assembly. Furthermore, the other end of the heat transfer structure may extend along the inner surface of the front glass panel.

The one end of the heat transfer structure may be connected to the side frame and may pass through the thermal insulator. The other end of the heat transfer structure may extend along the edge of the panel assembly or the inner surface of the peripheral portion of the front glass panel. The side frame and the heat transfer structure may be made of aluminum.

The side frame and the heat transfer structure may be integrally formed. The peripheral portion of the front glass panel may have the same size as the size of the entire door. The side frame may include an indented portion that is indented toward the inside of the door.

In accordance with still another aspect of the present invention, the other end of the rear frame may extend so as to cover the spacer. Preferably, the other end of the rear frame may extend to the position at which the spacer is disposed. The rear frame may be made of thermoplastic resin having a high thermal insulation value. Preferably, the rear frame may be made of ABS. The rear frame and the side frame may at least partially overlap each other.

In accordance with a further aspect of the present invention, the panel assembly may further be provided at a predetermined position on the edge thereof with a heating element. The front glass panel of the panel assembly may be the same size as the door.

Advantageous Effects

Advantageous effects obtained by the door for a home appliance and the home appliance including the same according to the present invention will now be described.

First, according to an embodiment of the present invention, there is an advantage of being able to simply and efficiently prevent condensation on the connecting region between the panel assembly and the frame assembly.

Second, according to another embodiment of the present invention, it is possible to prevent condensation by heating the connecting region between the panel assembly and the support of the panel assembly without having to heat the entire panel assembly. Accordingly, there is an advantage of being able to drastically reduce power consumption, compared to the case where the entire panel assembly is heated. Specifically, there is an advantage of being able to reduce power consumption to about ⅛ of the power consumption of heating the entire panel assembly 10. As a result, there are advantages of being able to simplify the structure of the heating element and to improve the freedom in design of the door.

Third, according to a further embodiment of the present invention, there is an advantage of being able to prevent condensation by modifying the structure of the support of the panel assembly. Specifically, there are advantages of being able to improve the aesthetic appearance of the door and of being able to prevent condensation on the connecting region between the panel assembly and the support of the panel assembly by making the front glass panel of the panel assembly have substantially the same size as the door.

DESCRIPTION OF IMPLEMENTATIONS AND BEST MODEL

Figure 1:
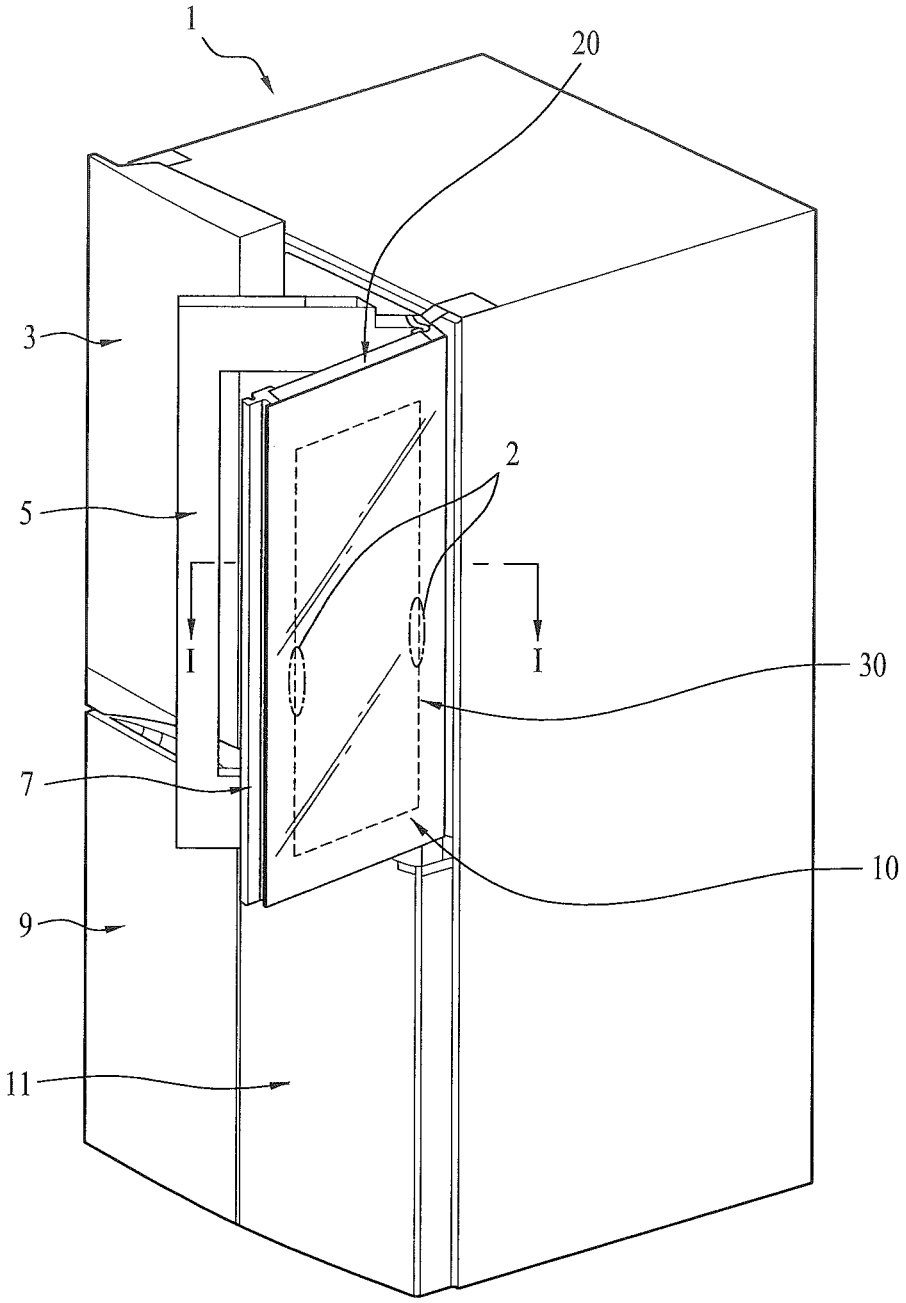
FIG. 1 is a diagram illustrating a perspective view of an example of a refrigerator according to an implementation of the present disclosure.

In the following description, a bottom freezer type refrigerator will be set forth as an example for convenience of explanation. However, implementations are not limited to a bottom freezer type refrigerator, and may also include a top-mounting type refrigerator, a side-by-side type refrigerator, or other suitable types of refrigerators. Furthermore, in the following description, a refrigerator including a refrigeration compartment door constituted by two doors, a main door and a sub door, will be set forth as an example for convenience of explanation. However, implementations are not limited thereto, and may also include a refrigerator including a refrigeration compartment door consisting of a single door or any suitable number of doors. As such, the present disclosure may be applied to any suitable type of refrigerator.

Furthermore, although the present disclosure describes refrigerators, the techniques described herein are not limited to refrigerators and may generally be applied to other types of home appliances that include a door. For example, implementations described herein may be applied to an appliance having a door that is equipped with a transparent material or equipped with a touch-input panel. In general, implementations of the present disclosure may be applied to various types of home appliances to reduce condensation in a panel of a door of the home appliance in a more energy-efficient and less complex manner. The examples that follow are described with reference to a refrigerator as an example of such an appliance.

An example of an overall structure of a refrigerator according to a preferred implementation of the present disclosure will be described with reference to FIG. 1. However, implementations are not limited to the exact structure of FIG. 1, and other refrigerator structures may be used with a different number of doors, a different installation mode of the doors, and the like Referring to the example in FIG. 1, a refrigerator includes a cabinet 1 that is provided with a refrigerating compartment at an upper part of the cabinet land with a freezing compartment at a lower part of the cabinet 1. The refrigerating compartment and the freezing compartment are opened and closed by doors. For example, the upper refrigerating compartment is opened and closed by door 3, door 5, and door 7, the latter of which may be a sub-door. The lower freezing compartment is opened and closed by door 9 and door 11.

In the example of FIG. 1, although the right side of the upper refrigerating compartment is illustrated as being opened and closed by both a main door 5 and a sub-door 7, implementations are not limited thereto, and the right refrigerating compartment door may be provided with a single door. Furthermore, although the refrigerating compartment and the freezing compartment are illustrated as being provided with side-by-side doors, implementations are not limited thereto, and each compartment may be provided with a single door or any suitable number and configuration of doors. According to the implementation of FIG. 1, the right refrigerating compartment door includes the main door 5, hingedly coupled to the cabinet 1, and the sub-door 7, hingedly coupled to the main door 5. The main door 5 is provided with an additional subsidiary storage space, such as a basket, that allows a user to access objects stored in the subsidiary storage space by opening only the sub-door 7, without necessarily opening the main door 5.

The sub-door 7 according to the implementation of FIG. 1 includes a panel assembly 10 and a frame assembly 20. The panel assembly 10 may define a front surface of the sub-door 7. The frame assembly 20 may include one or more frames that support the panel assembly 10.

In some implementations, the panel assembly 10 may include a transparent panel through which the inside of the refrigerator is visible from the outside thereof. In some implementations, the panel assembly 10 may include an interactive touch-input panel that enables a user to control one or more operations of the refrigerator from the outside. The frame assembly 20 structurally supports the panel assembly 10. The refrigerator door, for example, the sub-door 7, including the panel assembly 10 may have a thermal insulation value to prevent leakage of cold air to the outside as well as intrusion of external heat to the inside of the refrigerator. Accordingly, the panel assembly 10 and the frame assembly 20, which constitute the sub-door 7, may have a thermal insulation value.

However, there may be challenges in maintaining the thermal insulation of the panel assembly 10 and the frame assembly 20. In some implementations, the panel assembly 10 may be predominantly made of glass to provide transparent see-through capabilities. In some implementations, the panel assembly 10 may be configured with an interactive touch-input panel that enables a user's touch-input to control operations of the refrigerator. In either implementation, the panel assembly 10 may be difficult to thermally insulate. To address such challenges, the panel assembly 10 may be provided with insulation therein to provide thermal insulation. For example, the panel assembly 10 may include one or more internal thermal insulation panels and/or may be provided with other insulating material within the panel assembly 10 to improve thermal insulation.

While thermal insulation of the panel assembly 10 may help maintain a cold temperature inside the refrigerator, there may be additional challenges caused by the resulting differences in temperature and/or humidity between the inside and outside of the refrigerator. For example, condensation may form on the panel assembly 10 due to differences in temperature and/or humidity between the inside and outside of the refrigerator. Such condensation may reduce the overall thermal insulation capabilities of the panel assembly 10 and the frame assembly 20. To address problems caused by condensation, in some refrigerators, the entire panel assembly 10 may be heated to reduce the difference in temperature and/or humidity between the inside and outside of the panel assembly 10, thus reducing condensation on the panel assembly 10 while maintaining a cold temperature inside the refrigerator.

However, techniques such as those described above may not be able to prevent condensation on the panel assembly 10 in some situations. For example, in some scenarios, condensation may still occur on the panel assembly 10, in particular along the edges of the panel assembly 10 where the panel assembly 10 connects with the frame assembly 20. For example, as shown in FIG. 1, condensation may occur on a connecting region 10*a* at which the panel assembly 10 connects with the frame assembly 20. Such condensation may present challenges in maintaining a desired thermal insulation capability. Condensation on the connecting region 10*a* may be exacerbated in certain situations, such as in situations of greater ambient temperatures and higher humidity, for example ambient temperatures greater than 25° C. and relative humidity greater than 80%.

Condensation on the peripheral connecting region 10*a* may be exacerbated more than on other regions of the panel assembly 10, for example an interior region of the panel assembly 10, due to differences in physical properties between the panel assembly 10 and the frame assembly 20. Such differences in physical properties may cause differences in thermal insulation values between the panel assembly 10 and the frame assembly 20, thus posing greater challenges to reducing condensation. As a result, the thermal insulation value may be deteriorated at the connecting region 10*a*, more than in other portions of the panel assembly 10 or the frame assembly 20.

Accordingly, to address such challenges and reduce condensation, implementations described herein prevent condensation on the connecting region 10*a* between the panel assembly 10 and the frame assembly 20. In some implementations, the refrigerator may be configured to reduce condensation only on the connecting region 10*a* rather than on the entirety of the panel assembly 10 itself, which may help reduce energy consumption to more efficiently reduce condensation. In addition to improving thermal insulation, such techniques may also improve the usability of refrigerators in which the panel assembly 10 is transparent by allowing users to clearly view the inside of the refrigerator even under adverse conditions, which may be especially useful for household refrigerators.

As described above, condensation may be exacerbated at the connecting region 10*a* between the panel assembly 10 and the frame assembly 20 due to a form of heat bridge that is formed between two different physical materials. The difference in thermal insulation values between the panel assembly 10 and the frame assembly 20 may result in the connecting region 10*a* having a relatively low thermal insulation value. As a result, cold air in the refrigerator may tend to be concentrated on this connecting region 10*a*, thereby causing condensation.

To address these challenges, implementations described herein provide efficient heating at the connecting region 10*a* between the panel assembly 10 and the frame assembly 20. In some implementations, the door 7 may provide heating of the connecting region 10*a*. In some implementations, the heating may be provided in addition or as an alternative to changing the structure of the frame assembly 20. As such, implementations described herein may help reduce electric energy consumption as compared to techniques that heat the entirety of the panel assembly 10. Furthermore, implementations described herein may help simplify the structure of the refrigerator door and to improve the freedom in design and the aesthetic appearance of the door.

Figure 2:
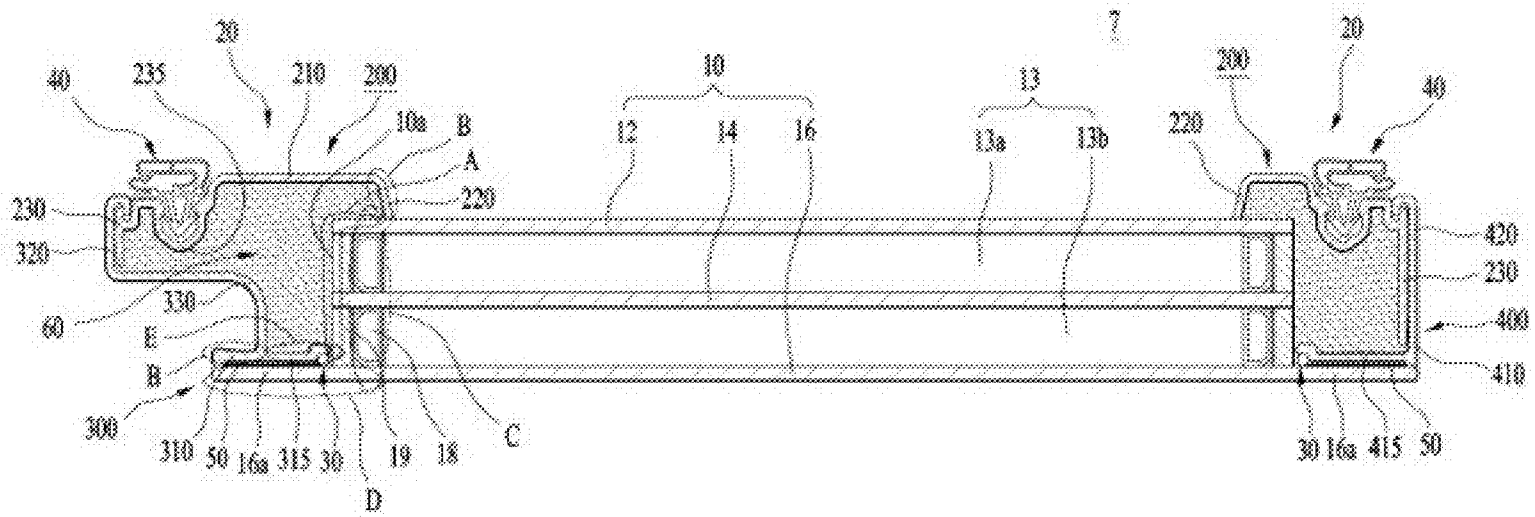
FIG. 2 is a diagram illustrating a cross-sectional view taken along line I-I in FIG. 1.
Figure 3:
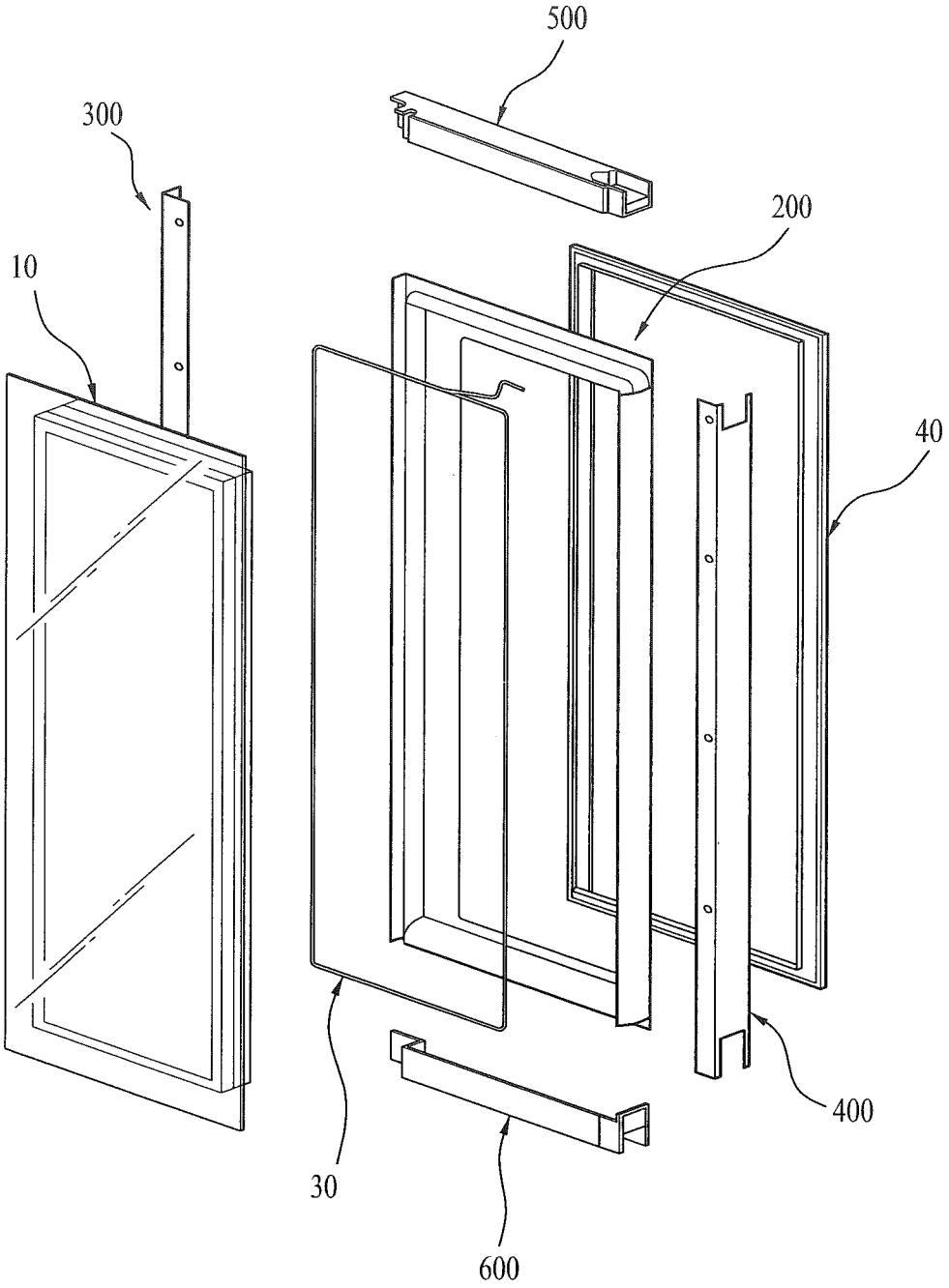
FIG. 3 is a diagram illustrating an exploded perspective view of an example of a sub-door shown in FIG. 1.

FIGS. 2 and 3 are diagrams illustrating an example of a refrigerator according to some implementations.

Although FIGS. 2 and 3 are described with reference to a sub-door 7, implementations are not limited to a sub-door and techniques described herein may be applied to any suitable door of a home appliance. Therefore, the subsequent description will simply refer to a door 7 for convenience. Furthermore, implementations of the panel assembly 10 of the sub-door are not limited to the panel 10 in FIGS. 2 and 3, and in general the panel assembly 10 may be any suitable panel with a heating structure as described herein.

The panel assembly 10 of door 7 may have a predetermined thermal insulation value, and may have an approximately rectangular shape, although implementations are not limited thereto. The frame assembly 20 is connected to the peripheral portion of, and thereby supports, the panel assembly 10, and may have a predetermined thermal insulation value. A heating element 30 is disposed near the connecting region 10*a* at which the panel assembly 10 and the frame assembly 20 are coupled to each other. The heating element 30 is disposed at a location that provides substantial heat to the connecting region 10*a*. For example, the heating element 30 may be disposed at a predetermined location on the connecting region 10*a*. As another example, the heating element 30 may be spaced apart from the connecting region 10*a* by a predetermined distance that enables substantial heating of the connecting region 10*a*.

Examples of individual components of the door 7 are described below.

An example of the panel assembly 10 is first described. In the example of FIG. 2, the panel assembly 10 may include a front panel 16. The front panel 16 defines a front appearance of the door 7. The front panel 16 may be made of a transparent material to enable a user to see through the door 7, or the front panel 16 may be an interactive touch-input panel to enable a user to apply a touch-input and control operations of the home appliance. As such, the front panel 16 may be a glass panel in the case of a transparent panel assembly 10, or may be a touch-input-enabled panel in the case of an interactive touch-input panel assembly 10.

The internal space defined within the panel assembly 10 may include thermal insulation behind the front panel 16. In the example of FIG. 2, the panel assembly 10 includes a middle panel 14 and a rear panel 12, which may improve the thermal insulation of the panel assembly 10. However, implementations are not limited the example of FIG. 2, and the panel assembly 10 may include any suitable thermal insulation behind the front panel 16, such as any suitable number of thermal insulation panels or other suitable thermal insulation behind the front panel 16. As such, in some implementations, the panel assembly 10 may include the front panel 16 and appropriate thermal insulation behind the front panel 16. In the case of a transparent panel assembly 10 of FIG. 2, the front panel 16, the middle panel 14, and the rear panel 12 are glass panels, and the spaces between the panels may be insulated with a suitable gas. In the case of an interactive touch-input panel assembly 10, the interior space defined within the panel assembly 10 may additionally include one or more sensors, such as touch sensors or electrostatic sensors, enabling touch-input detection on the front panel 16.

In some implementations, the front panel 16 may be larger than the remaining portions of the panel assembly 10. For example, in FIG. 2, the front panel 16 is larger than the middle panel 14 and the rear panel 12. In some implementations, the front panel 16 may have almost the same size as the door 7 and may cover the frame assembly 20 when viewed from a front of the refrigerator. As described above, since the front panel 16 of the panel assembly 10 defines the appearance of the door 7, the front panel 16 having the same size as the door 7 provides an improved aesthetic appearance as if the entire door were made of a single panel. To this end, the front panel 16 has a peripheral front panel portion 16*a*. The peripheral front panel portion 16*a* is a portion that expands in four directions beyond the edges of the rear panel 12 or the middle panel 14.

In some implementations, spacers 18 are interposed between the panels 12, 14 and 16 at the peripheral portions thereof. The panels 12, 14 and 16 may be coupled to each other using sealant 19 or other suitable coupling. The panels 12, 14 and 16 may be made of insulated material having a predetermined thermal insulation value. In implementations of a transparent panel assembly 10, two or more panels of thermally insulated glass may be used. In such implementations, the insulated glass panels 12, 14 and 16 may be made of low-emissivity glass configured to prevent heat loss due to radiation. The low-emissivity glass may be hard or soft low-emissivity glass, and in some implementations soft low-emissivity glass may be used to obtain high performance low emissivity.

In implementations of a transparent panel assembly 10, tempered glass is used that helps prevent breakage of the panels. The front panel 16 may be made of a glass that has controllable light transmissibility, for example color-changeable glass, such that the inside of the refrigerator is selectively visible from the outside. For example, when the lighting inside the refrigerator is turned off the front panel 16 may become opaque such that the inside of the refrigerator is not visible from the outside; and when the lighting inside the refrigerator is turned on, the front panel 16 may become transparent such that the inside of the refrigerator is visible from the outside. The color-changeable property of the front panel 16 may have any suitable implementation, for example a color glass panel or a glass panel, which is coated with an opaque material through TI deposition, may also be used. The front panel 16 preferably has a high thermal insulation value.

The spacer 18 provided between the panels in the panel assembly 10 may be constituted by, for example, aluminum (Al), a thermal protection spacer (TPS) and the like, and a thermal protection space is preferably used in order to improve the thermal insulation value at the portion at which the spacer 18 is installed. The spacer 18 preferably include therein a hygroscopic material.

The space 13*a* between the rear panel 12 and the middle panel 14 and the space 13*b* between the middle panel 14 and the front panel 16 may be vacuumized or may be filled with an insulating solid, liquid, or gas. In some implementations, the space 13*a* is filled with air or argon (Ar) gas. Since argon gas has a higher thermal insulation value than air and is an inert gas capable of resisting transformation through chemical action, it is preferable to use argon gas rather than air.

Next, the frame assembly 20 will be described in detail.

The frame assembly 20 preferably has a predetermined thermal insulation value. To this end, the frame assembly 20 may be constituted by a portion having sufficient rigidity to support the panel assembly 10 and another portion for substantially fulfilling the thermal insulation function, without being limited thereto. The frame assembly 20 defines a thermal insulation space which accommodates a thermal insulator 60 having a predetermined thermal insulation value. The frame assembly 20 is preferably coupled to the panel assembly 10.

The frame assembly 20 is preferably constituted by a plurality of components for the convenience of assembly, without being limited thereto. The overall construction of an example of the frame assembly 20 is first described with reference to FIG. 3.

In the example of FIG. 3, the frame assembly 20 includes a rear frame 200 disposed at the rear portion of the door, a side frame 300 and a side frame 400 disposed at both lateral side ends of the door, an upper frame 500 disposed at an upper end of the door, and a lower frame 600 disposed at a lower end of the door. In some implementations, such as those in which the panel assembly 10 is transparent, the rear frame 200, the side frames 300, 400, the upper frame 500, and the lower frame 600 define a thermal insulation space along the sides of the panel assembly 10. In such implementations of a transparent see-through panel assembly 10, the thermal insulation space may accommodate a thermal insulator 60, such as an insulating foam or other material or gas. The panel assembly 10 is coupled to the opening defined by the inner edges of the rear frame 200, the side frames 300, 400, the upper frame 500, and the lower frame 600. In some implementations, such as those in which the panel assembly 10 is transparent, a thermal insulator 60, such as an insulating foam or other material, may be formed in the space defined by the frames and the peripheral portion of the panel assembly 10 (see FIG. 2). Alternatively, in some implementations, such as where the panel assembly 10 is an interactive touch-input panel, the thermal insulator 60 may not be included, and instead thermal insulation may be generally provided inside the panel assembly 10, for example between the panels 12 and 14.

The rear frame 200 is disposed at the inner side of the door so as to serve to support the entire door. The frames 300, 400, 500 and 600 are disposed at lateral, upper, and lower sides of the panel assembly 10 so as to partially define the appearance of the door. The frames 300, 400, 500 and 600 may serve to prevent warpage of the door, and, in conjunction with the thermal insulator 60 in some implementations, may prevent condensation on the door.

The frames 300, 400, 500, and 600 may define a portion of the appearance of the door, and in some implementations may be decorative trims that are visible from the exterior of the door.

The rear frame 200, the side frames 300 and 400, and the relationship therebetween are now described with reference to FIG. 2. The relationship between the panel assembly 10, the rear frame 200, and the upper and lower frames 500 and 600 may have a similar relationship. The basic structures of the rear frame 200 and the side frames 300 and 400 are first described for convenience of explanation, and an example of the specific structures of the rear frame 200 and the side frames 300 and 400 are described in more detail in an implementation to be described later in which the structure of the panel assembly 10 is modified.

A cross-section of an example of the rear frame 200 is illustrated in FIG. 2. In this example, the rear frame 200 includes a first end 220 coupled to the panel assembly 10, a second end 230 coupled to the side frames 300 and 400, and a connecting portion 210 that connects the first end 220 to the second end 230. The first end 220 of the rear frame 200 is the portion that is connected to the rear panel 12 of the panel assembly 10, and the second end 230 is the portion that is connected to the side frames. The connecting portion 210, connecting the first end 220 to the second end 230, is substantially parallel to the front face of the cabinet of the refrigerator. The rear frame 200 is provided at an area thereof with a gasket 40. The inner surface of the gasket 40 is substantially parallel to the connecting portion 210 connecting the two ends of the rear frame 200. The first end 220 of the rear frame 200 is connected to, and thereby supports, the rear panel 12. The first end 220 of the rear frame 200 is configured to surround the spacer 18, which may have a low thermal insulation value.

The side frame 400 may include a rear frame connector 420 connected to the rear frame 200, and a panel connector 410 extending from the rear frame connector 420 substantially to the peripheral portion of the panel assembly 10, that is, to a position close to the peripheral front panel portion 16*a*. The panel connector 410 of the side frame 400 is connected to the end of the peripheral front panel portion 16*a* of the front panel 16.

The side frame 300 may also include a rear frame connector 320 connected to the rear frame 200, and a panel connector 310 extending from the rear frame connector 320 to the peripheral portion of the panel assembly 10, that is, to a position close to the peripheral front panel portion 16*a*. In some implementations, the side frame 300 includes an indented portion 330 that is indented toward the inside of the door between the rear frame connector 320 and the panel connector 310. The indented portion 330 may serve as a handle of the door. To define a space configured to receive a user's hand, the end of the peripheral front panel portion 16*a* that is connected to the side frame 300 is disposed at a position further inward than the rear frame connector 320 of the side frame 300. For example, the peripheral front panel portion 16*a* of the side frame 300 of the front panel 16 has a smaller width than the side frame 300. The panel connector 310 of the side frame 300 extends from a position that is spaced inward apart from the end of the peripheral front panel portion 16*a* of the front panel 16 to a position at the end of the peripheral front panel portion 16*a*, and is in close contact with the inner surface of the peripheral front panel portion 16*a*.

As described above, for implementations in which the panel assembly 10 is a transparent see-through panel, the rear frame 200 and the frames 300, 400, 500 and 600 may define a predetermined space therebetween, and the rear frame 200, the frames 300, 400, 500 and 600, and the peripheral portion of the panel assembly 10 may together define a space that is substantially enclosed. The space may be filled with the thermal insulator 60, for example, polyurethane foam (PU foam) so as to provide the frame assembly 20 with a predetermined thermal insulation value. For implementations in which the panel assembly 10 is not configured to be transparent, such as an interactive touch-input panel, the space including the thermal insulator 60 may not be necessary due to thermal insulation that fills the interior space of the panel assembly 10.

Next, the heating element 30 is described in detail.

As described above, under certain conditions, condensation may be exacerbated at the connecting region 10*a* between the panel assembly 10 and the frame assembly 20, more than at other portions of the panel assembly 10. Accordingly, implementations described herein are configured to prevent condensation on this connecting region 10*a*.

In some implementations, the heating element 30 is disposed near the connecting region 10*a* between the panel assembly 10 and the frame assembly 20, for example, either at the connecting region 10*a* or near the connecting region 10*a*. As a particular example shown in FIG. 2, the heating element 30 may be installed at a region, labeled region A in FIG. 2, along a side surface of the interior region of the panel assembly 10, between the thermal insulator 60 and the panel assembly 10. It is further preferable for the heating element 30 to be positioned close to the front surface of the door 7 so as to reduce condensation at the front surface of the panel assembly 10. As such, the heating element 30 may be provided at a position at which to heat the front surface of the door 7. To this end, the heating element 30 is preferably installed on a rear surface of the front panel 16 of the panel assembly 10, illustrated in FIG. 2 as region E.

In some implementations, the heating element 30 may be provided at a region where the frame assembly 20 connects with the panel assembly 10. For example, as illustrated in FIG. 2, the heating element may be provided at region B either on the inner surface or the outer surface of the first end 220 and panel connector 310 of the frame assembly 20. As such, the heating element may be provided at a portion at which the front and rear ends of the frame assembly 20 are mainly connected to the panel assembly 10. Therefore, the heating element 30 may be provided at any one or more of regions B, A, and E in FIG. 2, at which the panel assembly 10 is coupled to the frame assembly 20.

As described above, because the spacer 18 is configured to have a low thermal insulation value, the heating element 30 may be installed at a region C at which the spacer 18 is installed. For example, the heating element 30 may be installed in the spacer 18, may be installed in contact with the spacer 18, or may be installed near the spacer 18. However, in the case where the heating element 30 is installed in the spacer 18, the hygroscopic material in the spacer 18 may leak out, thereby causing condensation inside the panel assembly 10. Furthermore, because the spacer 18 is positioned inside the panel assembly 10, an additional mounting structure and additional wiring may be required to provide the heating element 30 in the spacer 18 or in contact with the spacer 18. Accordingly, there may be advantages in providing the heating element 30 along the peripheral portion of the panel assembly 10. If the heating element 30 is installed along a peripheral portion of the panel assembly 10, the heating element 30 may be provided close to the spacer 18 while simplifying the installation structure.

Although the above examples have described the heating element 30 provided close to the connecting region 10*a* between the panel assembly 10 and the frame assembly 20, implementations are not limited thereto. The heating element 30 may be installed at any position on the panel assembly 10 that enables the heating element 30 to transfer heat to the connecting region 10*a* and thus prevent condensation. This may be achieved even if the heating element 30 is slightly spaced apart from the connecting region 10*a*. For example, the heating element 30 may be provided at the peripheral portion of the front panel 16 of the panel assembly 10, that is, in at least one region of the inner and outer surfaces D of the peripheral front panel portion 16*a*.

In some implementations, the heating element 30 may be configured to heat only the connecting region 10*a* between the panel assembly 10 and the frame assembly 20. As such, in some implementations, the heating element 30 may be implemented as a heating wire, which may consume relatively little power. Accordingly, the heating element 30 configured to have a wire shape may be disposed along the peripheral portion of the panel assembly 10. The heating element 30 may be implemented as a heating wire and have a shape corresponding to the shape of the peripheral portion of the panel assembly 10 (see FIG. 3). By configuring the heating element 30 in such a manner to heat only the connecting portion 10*a*, rather than the entire panel assembly 10, power consumption may be reduced while still achieving reduced condensation. For example, in some implementations the heating element 30 configured according to this structure may consume only about 7 W of power, as compared to about 60 W or more that may be consumed by heating the entire panel assembly 10. As a result, power consumption may be reduced by a significant fraction, for example, to ⅛ of the power consumption of heating the entire panel assembly 10.

In some implementations, the side frames 300 and 400 may be disposed behind the peripheral front panel portion 16*a* of the front panel 16 so as to be invisible to a user when viewed from in front of the door. Accordingly, the front panel 16 of the panel assembly 10 may be the same size as the door and may have a flat surface, rather than a curved surface. In addition, the panel connector 310 of the side frame 300 may be connected to a rear surface of the peripheral front panel portion 16*a* of the front panel 16 and thus be hidden from view. Furthermore, the heating element 30 may be installed near the connecting region 10*a* between the panel assembly 10 and the frame assembly 20.

In addition, an opaque region 50 may be provided on an inner surface of the peripheral front panel portion 16*a* of the front panel 16, and the heating element 30 may be positioned on an inner surface of the opaque region 50. As such, this may prevent the heating element 30 from being visible from the outside of the door. The opaque region 50 may be implemented, for example, by an opaque material that is printed on the inner surface of the front panel 16.

The heating element 30 may be attached to the front panel 16 by any suitable heat-conductive attachment, for example by using aluminum (Al) adhesive tape. Heat from the heating element 30 can be efficiently transmitted to the peripheral region of the front panel 16 via the heat-conducting attachment. As another advantage, for implementations in which the panel assembly 10 is a transparent see-through panel, attaching the heating element 30 using aluminum (Al) adhesive tape may enable the heating element 30 to be temporarily held in place during the process of manufacturing the door, thus preventing the heating element 30 from being pushed into the panel assembly 10 upon insertion of the thermal insulator 60.

An example in which condensation is prevented in the refrigerator door according to the implementation of the present disclosure is now described with reference to FIG. 2.

In this implementation, the panel assembly 10 and the frame assembly 20 have a predetermined thermal insulation value whereby condensation does not occur on the sub-door 7 under general ambient conditions. However, under certain conditions, such as when the environment surrounding refrigerator becomes adverse, for example, during rainy seasons or in a tropical climate, the cold air in the refrigerator may leak to the outside of the door. Accordingly, the heating element 30 provided near the connecting region 10*a* results in heating of the cold air that leaks to the outside of the door. Consequently, even in scenarios of high relative humidity of air around the front panel 16, condensation does not occur at the connecting region 10*a* between the panel assembly 10 and the frame assembly 20. Furthermore, heat from the heating element 30 is transmitted via the heat-conductive attachment, such as aluminum adhesive tape, that attaches the heating element 30 to the front panel 16, as well as via the side frames 300 and 400, thereby preventing condensation even on the side frames 300 and 400. To this end, the side frames 300 and 400 are preferably made of metal having high heat conductivity.

Next, an example of a refrigerator door according to another implementation of the present disclosure is described with reference to FIG. 2. In the previous implementation, condensation on the door is prevented by providing the heating element 30. In this implementation, condensation on the door is prevented by modifying the structure of the frame assembly 20, either in addition to or as an alternative to providing the heating element 30.

An example of this modified frame assembly 20 is described with reference to the rear frame 200.

In the implementation shown in FIG. 2, the first end 220 of the rear frame 200 that is connected to the panel assembly 10 extends so as to cover the peripheral portion of the panel assembly 10. For example, the first end 220 may extend to cover the portion of the panel assembly 10 at which the spacer 18 is installed. By modifying the first end 220 of the rear frame 200 to cover the spacer 18, this may further help prevent cold air in the refrigerator from leaking to the outside through the spacer 18, even in scenarios where the spacer 18 has a relatively low thermal insulation value. In addition, if the space defined between the first end 220 of the rear frame 200 and the spacer 18 is filled with a thermal insulator, this may further improve the thermal insulation value. Although the first end 220 of the rear frame 200 may further extend inward towards the middle of the panel assembly 10 beyond the spacer 18, this may have a disadvantage of reducing the size of the portion of the panel assembly 10 that is exposed to the outside, thereby reducing the area through which a user views the inside of the refrigerator, in the case of a transparent panel assembly 10, or reducing the interactive touch-input area, in the case of a touch-input panel assembly 10. Therefore, in order to achieve a tradeoff between maximizing the size of the panel assembly 10 while minimizing heat transfer to the outside, the first end 220 of the rear frame 200 preferably extends to such an extent as to substantially cover the spacer 18. For example, the edge of the first end 220 of the rear frame 200 that is connected to the panel may coincide with the edge of the spacer 18 when viewed from the front.

The second end 230 of the rear frame 200 that is connected to the side frame 300 or 400 may be connected to the inner side of the side frame 300 or 400. The portion of the rear frame 200 that is connected to the side frame 400 is preferably disposed at the inner side of the rear frame connector 420 of the side frame 400 so as to overlap it, and is preferably almost the same length as the rear frame connector 420. Similarly, the portion of the rear frame 200 that is connected to the side frame 300 is also preferably connected to the rear frame connector 320 of the side frame 300 so as to overlap it. However, in some implementations, the portion of the rear frame 200 may also be configured to overlap the remaining portion of the rear frame connector 320 to exclude the indented portion 330.

For implementations that provide the thermal insulator 60 along the edges of the door, such as implementations in which the panel assembly 10 is a transparent window, the thermal insulator 60 is covered by the rear frame 200 having a high thermal insulation value, thereby more reliably preventing cold air that passes through the thermal insulator 60 from leaking out through the rear frame 200.

As the rear frame 200 is positioned inside the refrigerator and is the component that the cold air in the refrigerator first contacts, the rear frame 200 is preferably made of a material having a low coefficient of heat transfer. In addition, the rear frame 200 is preferably made of thermoplastic resin, and more preferably ABS, to facilitate moldability in manufacturing.

In the previous implementation, condensation is prevented by modifying the structure of the rear frame 200. Next, an example of a modified structure of the side frames 300 and 400 is described. The subsequent examples may also be applied to modify the upper frame 500 and the lower frame 600.

In this implementation, condensation is prevented by modifying the structure of the side frames 300 and 400. The side frames 300 and 400 preferably serve to increase the mechanical strength of the door and may further be configured to prevent condensation. Specifically, if the side frames 300 and 400 are exposed to air outside the refrigerator, the side frames 300 and 400 may be configured to absorb the heat attributable to the ambient temperature outside the refrigerator and exchange heat between the absorbed heat and the front surface of the door 7, which is cooled by the cold air in the refrigerator, thereby preventing condensation.

As such, the side frames 300 and 400 preferably absorb the heat attributable to the ambient temperature outside the refrigerator, and transfer the absorbed heat to the connecting region 10*a* between the panel assembly 10 and the frame assembly 20. As a result, heat exchange occurs at the connecting region 10*a*, which is cooled by the cold air in the refrigerator, thereby preventing condensation. Accordingly, the side frames 300 and 400 are preferably made of a heat-conducting material, for example a metal such as aluminum (Al), which has a predetermined mechanical strength and is capable of easily radiating heat energy.

As in the rear frame 200, the ends of the side frames 300 and 400 cover the spacer 18, which may have a relatively low thermal insulation value. However, this may have a disadvantage of increasing the thickness of the frame assembly 20 (in the anteroposterior direction of the door). In addition, as in the above implementation of the modified rear frame 200, extending the frame assembly 20 towards the interior region the panel assembly 10 (in the direction of the center of the door from the right and left ends and the upper and lower ends of the door) to cover the spacer 18 may reduce the size of the portion of the panel assembly 10 that is exposed to the outside. Accordingly, it is preferable for the front panel 16 of the panel assembly 10 to have the peripheral front panel portion 16*a*, and for the side frames 300 and 400 to be disposed behind the peripheral front panel portion 16*a*.

Furthermore, the refrigerator door preferably includes heat transfer structures 315 and 415 configured to efficiently transfer heat from the ambient temperature that is absorbed by the side frames 300 and 400 to the portion of the front panel 16 having a relatively low thermal insulation value. The heat transfer structures 315 and 415 are also disposed behind the peripheral front panel portion 16*a* of the front panel 16 of the panel assembly 10. In some implementations, one end of each of the heat transfer structures 315 and 415 are connected to the corresponding one of the side frames 300 and 400, and the other end of the heat transfer structures 315 and 415 extend to the connecting region 10*a* between the panel assembly 10 and the frame assembly 20.

An example of the side frame 400 is now described. The side frame 400 preferably includes the heat transfer structure 415, which extends from a predetermined position thereof to the connecting region 10*a* between the panel assembly 10 and the frame assembly 20. The heat transfer structure 415 preferably extends from the side frame 400 to a position close to the spacer 18. Furthermore, the heat transfer structure 415 more preferably extends so as to contact the inner surface of the peripheral front panel portion 16*a* of the front panel 16. The heat, which has been transferred to the side frame 400 from the ambient-temperature air outside of the refrigerator, is transferred to the connecting region 10*a* between the panel assembly 10 and the frame assembly 20, thereby preventing condensation on the connecting region 10*a*.

Similarly, the side frame 300 preferably includes the heat transfer structure 315, which extends from a predetermined position on the side frame 300 to the connecting region 10*a* between the panel assembly 10 and the frame assembly 20. The heat transfer structure 315 preferably extends from the panel connector 310 of the side frame 300 to the connecting region 10*a*, and more preferably to a position close to the spacer 18. Furthermore, the heat transfer structure 315 more preferably extends so as to contact the inner surface of the peripheral front panel portion 16*a* of the front panel 16. The heat, which has been transmitted to the side frame 300 from the ambient-temperature air outside the refrigerator, is transferred to the connecting region 10*a* between the panel assembly 10 and the frame assembly 20 through the heat transfer structure 315, thereby preventing condensation on the connecting region 10*a*.

In some implementations, the heating element 30 may additionally be provided on the front panel 16, disposed close to the connecting region 10*a* between the panel assembly 10 and the frame assembly 20. The heating element 30 may provide further heating of the front panel 16, in addition to the heat that is transferred by the heating structures 315 and 415 from the side frames 300 and 400. In such implementations, the heating element 30 may also contact the heat transfer structure 315 or 415.

Although the above examples disclose implementation including a modification in the structure of the rear frame 200 and implementations including a modification of the frames 300, 400, 500 and 600, the present disclosure is not limited thereto. For example, some implementations may include modifications of the structure of the rear frame 200 in addition to modifications of the structures of the frames 300, 400, 500 and 600.

An example of an operation of the implementation is now described. For convenience of explanation, an example is described that includes modifications in the structure of the rear frame 200 in addition to modifications of the structures of the frames 300, 400, 500 and 600.

The transfer of cold air inside the refrigerator to the outside of the refrigerator is primarily blocked by the rear frame 200. In addition, for implementations in which the panel assembly 10 is transparent, cold air may further be blocked by the thermal insulator 60. In some implementations, the rear frame 200 is made of thermoplastic resin having a high thermal insulation value, thus more efficiently blocking the transfer of cold air to the outside of the refrigerator. In such implementations, because the second end 230 of the rear frame 200 that is connected to the side frame 300 or 400 is disposed at the inner side of the side frame 300 or 400, this may further prevent cold air that has passed through the thermal insulator 60 from being transferred to the outside.

A portion of the cold air in the refrigerator may be transferred to the front surface of the door 7 without being blocked by the rear frame 200 or the thermal insulator 60. However, since the side frames 300 and 400 are made of metal having high heat conductivity, the side frames 300 and 400 may absorb heat of external air having an ambient temperature outside the refrigerator, and may transfer the absorbed heat to the inside of the side frames 300 and 400. Consequently, the heat transferred from the side frames 300 and 400 heats the front surface of the sub door 7, which is cooled by the cold air transmitted to the front surface without being blocked by the rear frame 200 or by the thermal insulator 60, thereby preventing condensation on the front surface. Furthermore, the ambient-temperature heat transferred to the side frames 300 and 400 is more efficiently transferred to the connecting region 10*a* between the panel assembly 10 and the frame assembly 20 through means of the heat transfer structures 315 and 415 provided at the side frames 300 and 400. The resulting heat transferred to the front panel 16 more efficiently prevents condensation. Furthermore, implementations in which the heating element 30 is additionally included may further provide more efficient prevention of condensation.

The heat transfer structures 315 and 415 according to the present disclosure may be implemented in various manners to transfer heat from the side frames 300 and 400 of the door to the peripheral front panel portion 16*a* at the periphery of the front panel 16. As such, the heat transfer structures 315 and 415 may transfer heat to a portion of the panel assembly 10 that connects with the frame assembly 20, namely the peripheral connecting region 10*a* shown in FIGS. 1 and 2, where the panel assembly 10 is most susceptible to condensation. Furthermore, by being confined to this peripheral front panel portion 16*a*, the heat transfer structures 315 and 415 may remain outside of an interior region of the panel assembly 10, where the panel assembly 10 may be provided with transparent glass panels in the case of a transparent panel assembly 10 or where the panel assembly 10 may be provided with sensors and electronic components in the case of an interactive touch-input panel assembly 10. Various implementations of the heat transfer structures 315 and 415 portion are described with reference to FIGS. 4A to 4E.

FIGS. 4A to 4E illustrate different examples of the heat transfer structure 315 that transfers heat between the side frame 300 and the front panel 16. Similar structures may be used for the heat transfer structure 415 between the side frame 400 and the front panel 16. However, implementations are not limited to these examples, and may include other types of heat transfer structures that transfer heat between the side frames 300, 400 and the front panel 16, specifically the peripheral front panel portion 16*a* of the front panel 16.

Figure 4A:
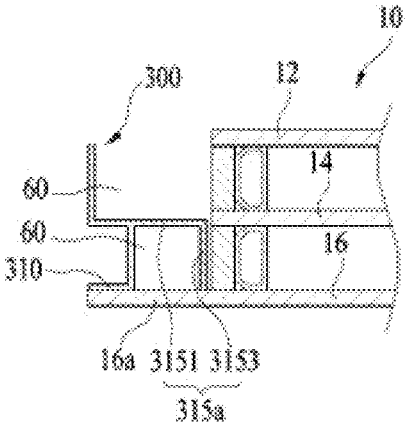
FIGS. 4A to 4E are diagrams illustrating cross-sectional views of various implementations of the frame assembly shown in FIG. 2.

In the first example illustrated in FIG. 4A, the heat transfer structure includes a heat transfer portion 315*a* configured to penetrate the thermal insulator 60. The heat transfer portion 315*a* includes a penetrating portion 3151 and a contact portion 3153. The penetrating portion 3151 may extend from the side frame 300 and penetrate the space defined between the side frame 300 and the side surface of an interior region of the panel assembly 10. In the case of a transparent panel assembly 10, this space may be filled with the thermal insulator 60. The contact portion 3153 extends from the penetrating portion 3151 and contacts along the side surface of the interior region of the panel assembly 10. In this case, the contact portion 3153 preferably has a predetermined length so as to extend along the side surface of the interior region of the panel assembly 10. In addition, the panel connector 310 of the side frame 300 may be connected to the peripheral front panel portion 16*a* of the front panel 16 at a position spaced inward apart from the end of the peripheral front panel portion 16*a*, thus providing additional transfer of heat from the side frame 300 to the peripheral front panel portion 16*a* of the front panel 16.

Figure 4B:
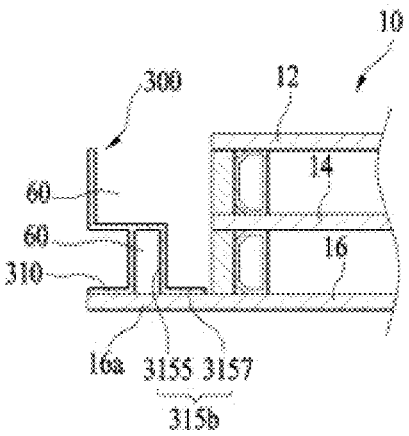

In the second example illustrated in FIG. 4B, the heat transfer structure includes a heat transfer portion 315*b*. The heat transfer portion 315*b* includes a penetrating portion 3155 and a contact portion 3157. The penetrating portion 3155 penetrates the space defined between the side frame 300 and the side surface of an interior region of the panel assembly 10. The contact portion 3157 extends from the penetrating portion 3155 and contacts along the inner surface of the peripheral front panel portion 16*a* of the front panel 16. In this case, the contact portion 3157 preferably has a predetermined length so as to extend along the inner surface of the peripheral front panel portion 16*a* of the front panel 16. In addition, the panel connector 310 of the side frame 300 may be connected to the peripheral front panel portion 16*a* of the front panel 16 at a position spaced inward apart from the end of the peripheral front panel portion 16*a*, thus providing additional transfer of heat from the side frame 300 to the peripheral front panel portion 16*a* of the front panel 16.

Figure 4C:
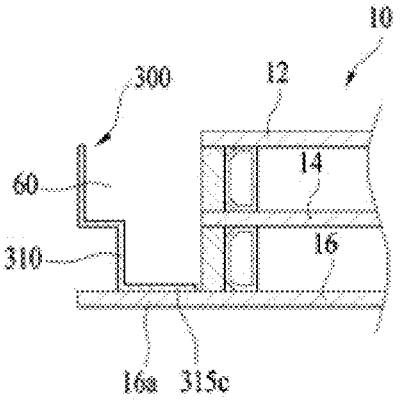

In the third example illustrated in FIG. 4C, the heat transfer structure 315 includes a heat transfer portion 315*c* extending from the panel connector 310 of the side frame 300 to a location near the side surface of the interior region of the panel assembly 10. In particular, the panel connector 310 of the side frame 300 is connected to the front panel 16 and is disposed at a location spaced inward apart from the outer edge of the peripheral front panel portion 16*a* of the front panel 16. The heat transfer portion 315*c* may thus extend from the panel connector 310 to a location near the side surface of the panel assembly 10. In this case, the panel connector 310 provides a conduit for heat transfer between the side frame 300 and the heat transfer structure, which in turn transfers heat to the peripheral front panel portion 16*a* of the front panel 16.

Figure 4D:
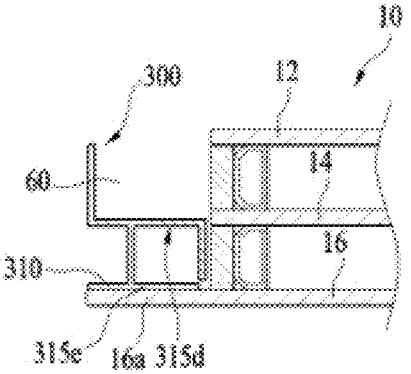
Figure 4E:
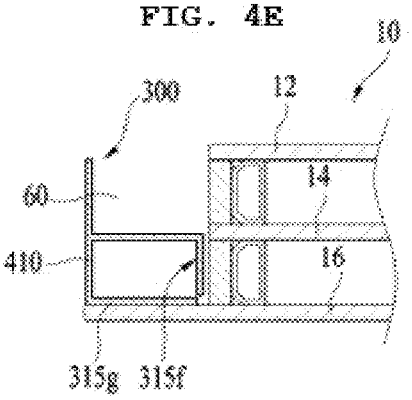

As illustrated the fourth example FIG. 4D and FIG. 4E, the heat transfer structure may include one or more heat transfer portions that extend along both the side of the panel assembly 10 and that also extend along the front panel 16. Specifically, FIG. 4D illustrates a heat transfer structure including two heat transfer portions 315*d* and 315*e*, wherein the heat transfer portion 315*d* is connected to and extends along the side surface of the interior region of the panel assembly 10, and the heat transfer portion 315*e* is connected to and extends along the front panel 16. Another example is illustrated in FIG. 4E, in which the heat transfer structure includes heat transfer portions 315*f* and 315*g*, wherein heat transfer portion 315*f* is connected to and extends along the side surface of the interior region of the panel assembly 10, and heat transfer portion 315*g* is connected to and extends along the peripheral front panel portion 16*a* of the front panel 16. In these examples, the panel connector 310 also transfers heat between the side frame 300 to the peripheral front panel portion 16*a* of the front panel 16.

In some implementations, the heat transfer structure 315 may constitute a different material than the side frame 300, and may be connected to the side frame 300, for example via the panel connecter 310. Alternatively, in some implementations, the heat transfer structure 315 may be an extension of, and constituting the same material as, the side frame 300 and the panel connector 310. In addition to the heat transfer structure 315 shown in FIGS. 4A to 4E, the panel assembly 10 may be additionally provided with a heating element, such as heating element 30 shown in FIG. 2, that provides additional heating of the peripheral front panel portion 16*a* of the front panel 16.

Figure 5:
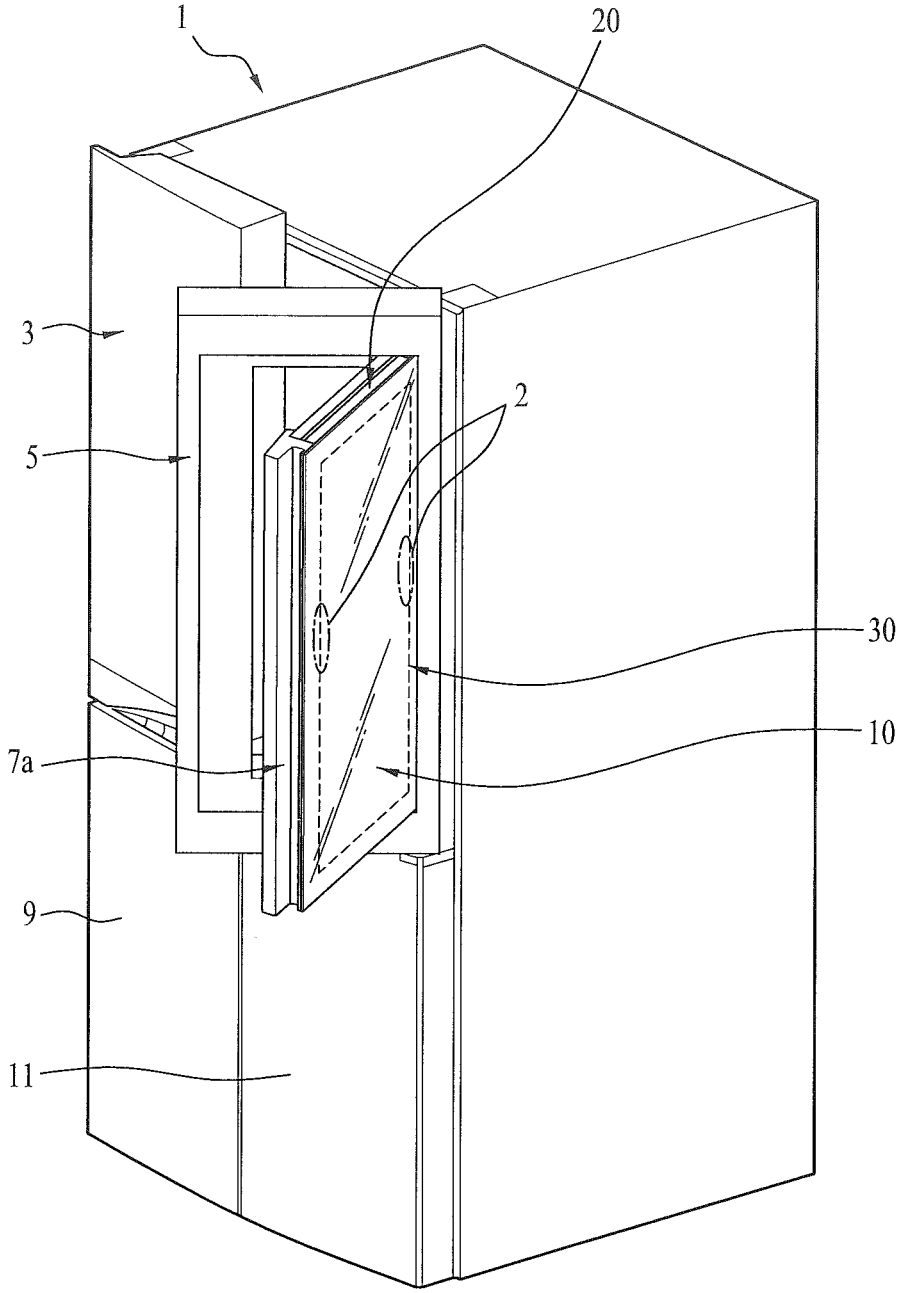
FIG. 5 is a diagram illustrating a perspective view of an example of a refrigerator according to another implementation of the present disclosure.

The present disclosure is not limited to the above-described implementations, and may be applied to various types of doors that include panels. For example, although the above examples have been described for the case in which the main door 5 is the same size as the sub-door 7, the present disclosure is not limited thereto. In some implementations, the sub-door may be smaller in size than the main door, so as to fit within the main door when the sub-door is closed. An example of this sub-door configuration is illustrated in FIG. 5, in which sub-door 7*a* fits within the main door 5. As such, the above implementations of heat transfer structures may also be applied to the case in which the sub-door 7*a* has a smaller size than the main door 5.

Figure 6:
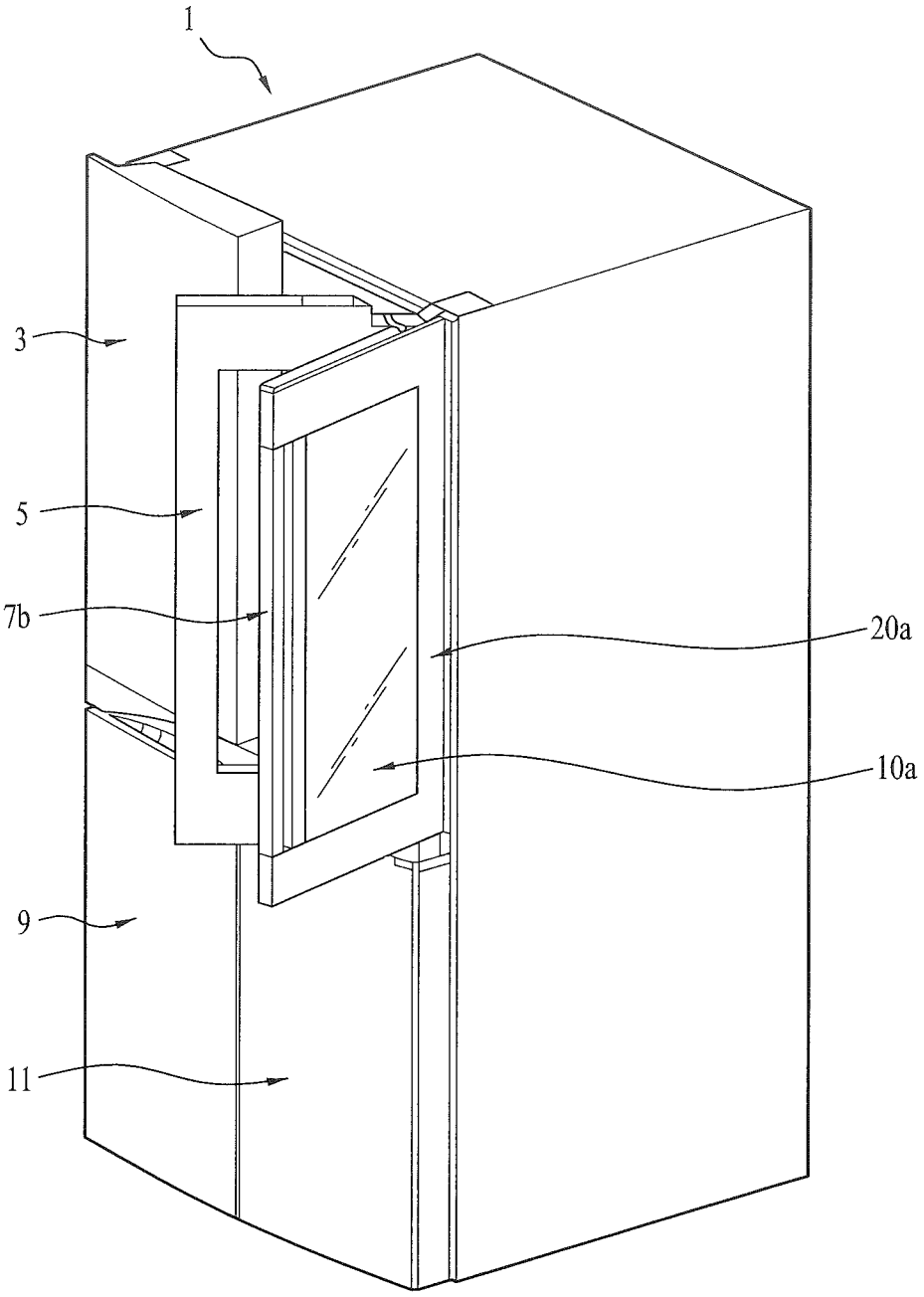
FIG. 6 is a diagram illustrating a perspective of an example of a sub-door as shown in FIG. 5.
Figure 7:
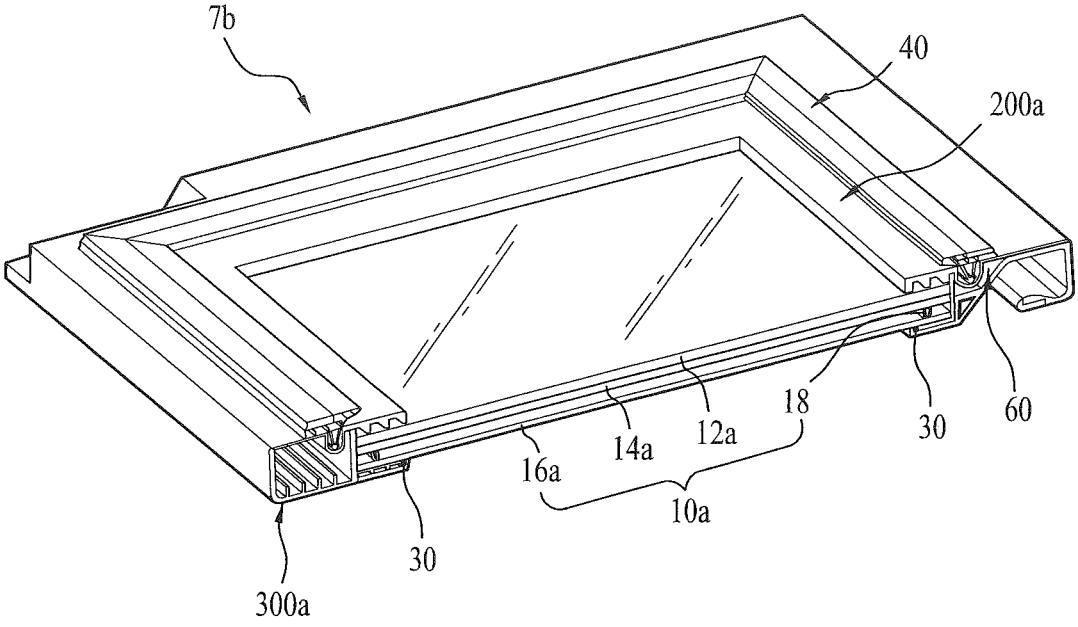
FIG. 7 is a diagram illustrating a perspective view of an example of a refrigerator according to a further implementation of the present disclosure.

Furthermore, although the above examples have been described with reference the structure in which the front panel 16 of the panel assembly 10 covers the entire front surface of the sub-door 7, the present disclosure is not limited thereto. For example, as illustrated in FIGS. 6 and 7, implementations may also include a sub-door 7*b* having a panel assembly 10*a* in which a front panel 16*a* of the panel assembly 10*a* does not cover the entire surface of the sub-door 7*b*. As shown in FIG. 7, the front panel 16*a* of the panel assembly 10*a* may be surrounded by a separate structure, for example the side frames 300*a* and 200*a*, that are visible from the front of the refrigerator. The door 7*b* includes a frame assembly 20*a* that supports the panel assembly 10*a*, and a heating element 30 disposed at the periphery of the panel assembly 10*a* on the connecting region between the panel assembly 10*a* and the frame assembly 20*a*. The frame assembly 20*a* includes a first frame 200*a* and a second frame 300*a*, and heat transfer structures may be implemented that transfer heat from the side frames 200*a* and 300*a* to the front panel 16*a* in an analogous manner to the structures of FIGS. 4A to 4E.

The present disclosure is not limited to the above-described implementations, and those skilled in the art will appreciate that various modifications are possible, without departing from the scope and spirit of the disclosure.

DESCRIPTION OF REFERENCE NUMERALS

5, 7: door
10: panel assembly
20: frame assembly
30: heating element

The invention claimed is:

1. A refrigerator comprising:
a cabinet defining a storage chamber therein; and
a door connected to the cabinet and configured to open and close the storage chamber,
wherein the door comprises:
an outer door frame having an opening defined therethrough, and
a panel assembly configured to cover the opening of the outer door frame, the panel assembly comprising:
a front panel that defines a front surface of the door,
an insulating panel provided behind the front panel, and
a spacer arranged between the front panel and the insulating panel,
wherein the outer door frame of the door comprises:
a first frame connected to the front panel of the panel assembly, and
a second frame connected to the first frame,
wherein the panel assembly and the outer door frame together define an insulation space in which an insulating material is provided,
wherein the first frame of the outer door frame comprises:
a first part comprising a recessed part that is recessed toward the spacer, the recessed part having (i) a first surface that defines a recessed space exposed to an outside of the outer door frame and (ii) a second surface that is opposite the first surface and is in contact with the insulating material provided in the insulation space,
a second part that extends from the first part in a direction away from the spacer and defines a portion of an appearance of the door,
a frame connector that is bent from the second part in a direction away from the front panel and defines another portion of the appearance of the door, and
at least one heat transfer unit that extends from the second surface toward the spacer of the panel assembly along a rear surface of a first portion of the front panel,
wherein the second frame comprises:
a first end connected to the panel assembly,
a second end connected to the frame connector of the first frame,
a connecting portion that connects the first end and the second end, the connecting portion defining a gasket receiving portion that receives a gasket,
wherein the insulation space comprises a first space, a second space, and a third space that are in communication with one another,
wherein the insulating material is provided (i) in the first space between the second end of the second frame and the gasket receiving portion, (ii) in the second space between the second part of the first frame and the gasket receiving portion, and (iii) in the third space between the connection portion and the at least one heat transfer unit, and
wherein a portion of the insulation material in the third space is in contact with the first end of the second frame and the at least one heat transfer unit.

2. The refrigerator of claim 1, wherein a masking layer is provided on the rear surface of the first portion of the front panel and the recessed part is provided to a region corresponding to the masking layer of the first portion.

3. The refrigerator of claim 2, wherein the recessed part is in contact with the rear surface of the first portion of the front panel.

4. The refrigerator of claim 1, wherein the second part is provided outside the first portion of the front panel.

5. The refrigerator of claim 1, wherein the spacer is positioned closer to the second surface than to the gasket.

6. The refrigerator of claim 1, wherein the first end of the second frame is provided behind the insulating panel.

7. The refrigerator of claim 6, wherein the insulating panel comprises a first face that faces the front panel and a second face opposite to the first face, and the first end of the second frame is contact with the second face.

8. The refrigerator of claim 7, wherein the insulating panel further comprises a third face that connects the first face to the second face, the third face is positioned closer to the first end of the second frame than the gasket.

9. The refrigerator of claim 1, further comprising a heater provided behind a rear surface of the first portion of the front panel.

10. The refrigerator of claim 9, wherein the heater is provided between the at least one heat transfer unit and the rear surface of the first portion of the front panel.

11. The refrigerator of claim 9, wherein the heater is positioned closer to the spacer than the recessed part.

12. The refrigerator of claim 1, wherein a portion of the insulation space is defined by the second surface of the recessed part and the at least one heat transfer unit.

13. The refrigerator of claim 1, wherein the at least one heat transfer unit is positioned at a first side of the second surface and the gasket is positioned at a second side of the second surface opposite the first side.

14. The refrigerator of claim 1, wherein a portion of the insulating material in the first space is in contact with the second end of the second frame, the gasket receiving portion, and the second part of the first frame.

15. The refrigerator of claim 1, wherein a portion of the insulating material in the second space is in contact with the second part of the first frame and the gasket receiving portion.

* * * * *